US011624224B2

(12) United States Patent
Kovach

(10) Patent No.: US 11,624,224 B2
(45) Date of Patent: Apr. 11, 2023

(54) AUTOMOTIVE LIFT-OFF HINGE WITH INTEGRATED DOOR CHECK

(71) Applicant: Multimatic Inc., Markham (CA)

(72) Inventor: Christopher Robert Kovach, Schomberg (CA)

(73) Assignee: MULTIMATIC INC., Markham (CA)

( * ) Notice: Subject to any disclaimer, the term of this patent is extended or adjusted under 35 U.S.C. 154(b) by 6 days.

(21) Appl. No.: 17/623,742

(22) PCT Filed: Jun. 17, 2021

(86) PCT No.: PCT/US2021/037817
§ 371 (c)(1),
(2) Date: Dec. 29, 2021

(87) PCT Pub. No.: WO2021/257821
PCT Pub. Date: Dec. 23, 2021

(65) Prior Publication Data

US 2022/0243511 A1 Aug. 4, 2022

Related U.S. Application Data

(60) Provisional application No. 63/040,139, filed on Jun. 17, 2020.

(51) Int. Cl.
*E05D 7/10* (2006.01)
*E05D 5/12* (2006.01)
(Continued)

(52) U.S. Cl.
CPC ..... *E05D 7/1044* (2013.01); *E05D 5/062* (2013.01); *E05D 5/121* (2013.01); *E05D 5/14* (2013.01);
(Continued)

(58) Field of Classification Search
CPC ..... E05D 7/1044; E05D 5/062; E05D 5/121; E05D 5/14; E05D 7/105; E05D 11/06;
(Continued)

(56) References Cited

U.S. PATENT DOCUMENTS 4,765,025 A * 8/1988 Salazar ..... E05D 7/105 16/261
4,854,009 A * 8/1989 Brockhaus ..... E05D 5/12 16/273
(Continued)

FOREIGN PATENT DOCUMENTS

DE 10226881 A1 7/2003

OTHER PUBLICATIONS

International Preliminary Report on Patentability for International Application No. PCT/US2021/037817 dated Dec. 29, 2022.
(Continued)

*Primary Examiner* — Jeffrey O'Brien
(74) *Attorney, Agent, or Firm* — Carlson, Gaskey & Olds, P.C.

(57) ABSTRACT

An automotive lift-off hinge joint to rotationally connect an automotive door and body comprises first and second door side hinge brackets and a body side hinge bracket. A detent shaft is provided with an interiorly threaded intermediate portion adapted to receive a removable threaded fastener and with a shaped detent shaft feature adapted to engage a similarly shaped pyramidal portion of a guide pin fastened to the body side hinge bracket. The detent shaft is rotationally mounted within a cylindrical check mechanism and secured in relation to the first and second door side hinge brackets. Bushings in door side hinge bracket apertures allow rotation of portions of the detent shaft extending through the apertures. The pyramidal shaped portions are preferably square.

7 Claims, 7 Drawing Sheets

(51) Int. Cl.
*E05D 11/06* (2006.01)
*E05D 5/06* (2006.01)
*E05D 5/14* (2006.01)
*E05D 11/10* (2006.01)

(52) U.S. Cl.
CPC ..... *E05D 7/105* (2013.01); *E05D 11/06* (2013.01); *E05D 11/1057* (2013.01); *E05D 2005/122* (2013.01); *E05D 2005/124* (2013.01); *E05D 2011/1035* (2013.01)

(58) Field of Classification Search
CPC ..... E05D 11/1057; E05D 2005/122; E05D 2005/124; E05D 2011/1035
See application file for complete search history.

(56) References Cited

U.S. PATENT DOCUMENTS 4,858,274 A * 8/1989 Harrison ..... E05D 7/1044 16/265
4,881,298 A * 11/1989 Turnbull ..... E05D 5/062 296/147
5,092,017 A * 3/1992 Hatano ..... E05D 5/14 16/342
5,237,723 A * 8/1993 Little ..... E05D 5/10 16/261
5,706,556 A * 1/1998 Kluting ..... E05D 5/10 16/265
6,073,308 A * 6/2000 Linnenbrink ..... E05D 11/1071 16/334
6,481,056 B1 * 11/2002 Jesse ..... E05D 11/1057 16/334
7,325,276 B2 * 2/2008 Kim ..... E05D 7/1005 16/262
7,748,768 B2 * 7/2010 Hofacker ..... E05D 5/16 16/374
8,347,460 B2 * 1/2013 Minegishi ..... E05D 11/1057 16/334
8,505,164 B2 * 8/2013 Katou ..... E05D 3/02 16/386
8,510,914 B2 * 8/2013 Minegishi ..... E05D 11/1057 16/334
10,378,257 B2 * 8/2019 Witting ..... F16B 37/08
10,738,520 B2 * 8/2020 Cherry ..... E05D 11/06
10,851,570 B2 * 12/2020 Smith ..... E05D 11/06
11,434,676 B2 * 9/2022 Morinaga ..... F16C 11/04
2004/0231103 A1 * 11/2004 Magnuson ..... E05D 5/121 16/340
2004/0231104 A1 * 11/2004 Kingelhofer ..... E05D 11/084 16/342
2006/0273621 A1 * 12/2006 Shaw ..... E05D 7/121 296/146.11

OTHER PUBLICATIONS

International Search Report for International Application No. PCT/US2021/037817 dated Oct. 1, 2021.

* cited by examiner

AUTOMOTIVE LIFT-OFF HINGE WITH INTEGRATED DOOR CHECK

CROSS-REFERENCE TO RELATED APPLICATIONS

This application claims priority to U.S. Provisional Application No. 63/040,139 which was filed on Jun. 17, 2020, and is incorporated herein by reference.

FIELD OF THE INVENTION

This invention is in the field of automotive door hinges, and in particular, lift-off hinge joints.

BACKGROUND OF THE INVENTION

Essentially all modern automotive factories assemble doors made from sheet metal to the vehicle body prior to final painting. These structures prior to final painting are called door-in-white and body-in-white respectively. The assembly takes place using hinges which rotationally join the doors to the body. Use of the hinges at this stage facilitates the fitting of the doors to the body in the correct orientation. The final painting then occurs with the doors in place.

At this point in production, following painting, it is useful to remove the doors from the body. This allows efficient further assembly of various components to the door on a parallel line, including window glass, seals, audio speakers, door inner trim, etc. Various techniques have been used to permit the doors to be easily removed from, and reassembled with, the body. Lift-off hinge joints have been used advantageously for this purpose for some years.

Lift-off hinges tend to suffer from a number of problems including holding the doors securely enough to correctly orient them for painting without damaging the hinge components, the door or the body when they are removed and then reinstalled. Obtaining a secure and repeatable registration of the hinge components is most desirable. It would also be preferable to allow disassembly and reassembly in only certain positions to ensure consistent reassembly of the doors to the body in the proper orientation. In addition, it would be desirable to provide hinge joint components configured to allow simple and convenient disassembly and reassembly by consumer end users, such as with certain sport vehicles.

Virtually all vehicles require doors which are held in multiple discrete open positions for user ingress and egress, loading and the like. This is facilitated by door checkers. Door checkers may be separate from the associated hinges or integrated with the hinges. It would be advantageous to have a secure, conveniently usable lift-off hinge combined with a door checker.

SUMMARY OF THE INVENTION

In a preferred embodiment of the invention, a lift-off hinge joint comprises a pair of door side hinge brackets, a body side hinge bracket, a detent shaft with a shaped detent shaft feature, a guide pin, a check mechanism and a lift-off fastener. The detent shaft is rotatably connected to the two spaced apart door side hinge brackets using bushings.

The detent shaft is rotatably mounted within a check mechanism which surrounds the detent shaft. Rotational interaction of the detent shaft with the check mechanism generates the required detent torque to check the door in multiple desired positions. The check mechanism has spring preloaded rollers that interact with grooves on the detent shaft to generate the check forces. See, for example, U.S. Pat. No. 6,481,056 entitled "Integrated Door Check Hinge for Automobiles", which is incorporated by reference in its entirety. The shaped detent shaft feature registers with a correspondingly shaped portion of the guide pin.

The guide pin is fastened to the body side hinge bracket. This registration places the door side and body side hinge brackets in the correct orientation for assembly and reassembly. It has been found that a non-circular base, for example, a square base pyramidally shaped intermediate portion of the guide pin, is ideal to ensure proper orientation of the door for assembly and reassembly. Finally, a removable lift-off fastener, in the form of a bolt with a threaded end, is inserted through an orifice in the body side hinge bracket, though a bore in the guide pin, and tightened by threading into a correspondingly internally threaded bore of the detent shaft. Typically, a washer is provided between the head of the bolt and the body side hinge bracket, making the bolt easily installed and removed.

In practice, the square shape of the intermediate portion of the guide pin and corresponding detent shaft feature may be modified with rounded corners to facilitate smooth contact of the parts and to prevent abrasion of the parts during assembly and disassembly. The guide pin is provided with a tenon at one end which registers with a correspondingly shaped opening in the body side hinge bracket and may be swaged to join the two components. The guide pin and body side hinge bracket may also be joined by staking, welding, or similar means of fastening. The tenon and corresponding opening in the door side hinge bracket may be square to match the profile of the opposite end of the guide pin, or may be provided with another polygonal shape, such as a triangle or hexagon, to prevent relative rotation between the tenon and door side hinge bracket.

Similarly, the opposite end of the guide pin may have a square or non-square polygonal shape to fit non-rotatably within the bore of the detent shaft. Only the square base pyramidally shaped portion of the guide pin engages with the correspondingly shaped portion of the detent shaft feature. This generates a form fit. The opposite end of the guide pin, on the other hand, acts as a guide element for temporary retention of the detent shaft to the guide pin during hinge assembly, without actual engagement. Preferably, the clearance between the opposite end of the guide pin and the bore of the detent shaft prevents these two features from interfering with each other.

The square shape of the intermediate pyramidal portion of the guide pin has been found to be optimal to facilitate correct assembly and reassembly of the doors to the body. Automotive side doors typically open between 65 degrees and 85 degrees. In practice, a door cannot be rehung in a closed or almost closed position since it is too difficult for a worker or a robot to manipulate the door in such close quarters. In addition, for example, if it were attempted to rehang the door at 120 degrees open, the sheet metal of the door and body could come into contact causing damage to both. Thus, the 90 degree indexing of the square base pyramidal pin permits the door to be re-hung only in the correct position allowing access for workers or machines and preventing contact between sheet metal parts with attendant damage. Other polygonal shapes would not provide this optimal, essentially fool-proof, indexing of parts. Although very useful in a factory setting, an essentially fool-proof indexing of parts is particularly beneficial in the case of consumer use of these lift-off hinges to prevent damage as sport vehicle doors are repeatedly removed and replaced.

A typical vehicle door is mounted to the body with two hinge joints, namely an upper and a lower hinge joint. The above described hinge joint with an integral door checker may be mounted in either position, although the upper position may be preferred. A similar guide pin may be provided on the opposite, typically lower, door side hinge bracket. In this way the door can be lifted up and off the body side hinge brackets and reinstalled in the correct orientation without use of the lift-off fastener initially. This greatly simplifies the door assembly operation.

Finally, when the lift-off fastener is inserted and tightened, the square base pyramidal intermediate portion of the guide pin and the correspondingly shaped portion of the detent shaft, the detent shaft feature, engage tightly to restrain all degrees of freedom of motion between the various components, with the exception of the permitted rotational motion of the detent shaft in relation to the checker mechanism and in relation to the door side hinge brackets. This creates a secure, structural joint.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
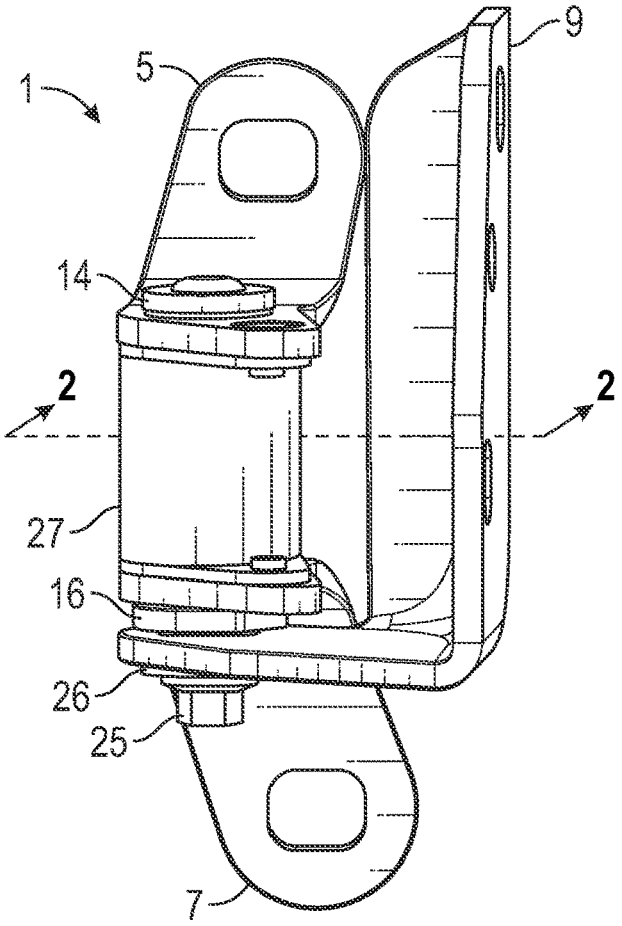
FIG. 1 is a perspective view of the lift-off hinge with integrated door check of the invention.

An automotive lift-off hinge with integrated door check 1 (also referred to simply as the automotive lift-off hinge) is adapted to rotationally connect a vehicle door 3 and a vehicle body (not illustrated). The lift-off hinge 1, as illustrated in FIG. 1, comprises a first door side hinge bracket 5, a second door side hinge bracket 7, and a body side hinge bracket 9. The hinge brackets are typically stamped from sheet metal but may be profile pieces formed using hot rolling, casting, etc.

Figure 8:
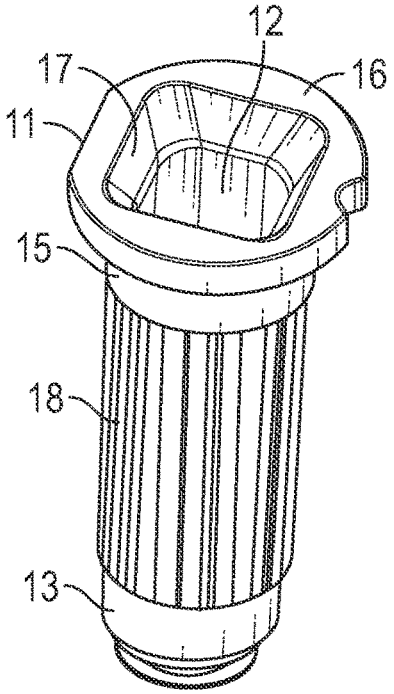
FIG. 8 is a perspective view of the detent shaft of the invention.

The lift-off hinge 1 further comprises a detent shaft 11 with a first end 13, a second end 15, and a shaft hollow core 12 provided with a shaped detent shaft feature 17. The isolated detent shaft 11 is illustrated, for example, in FIG. 8. In the shaft hollow core 12 adjacent the first end 13 is a first section 19 of the shaft hollow core 12. The shaft hollow core 12 of the detent shaft 11 further comprises and interiorly threaded intermediate portion 23.

Figure 4:
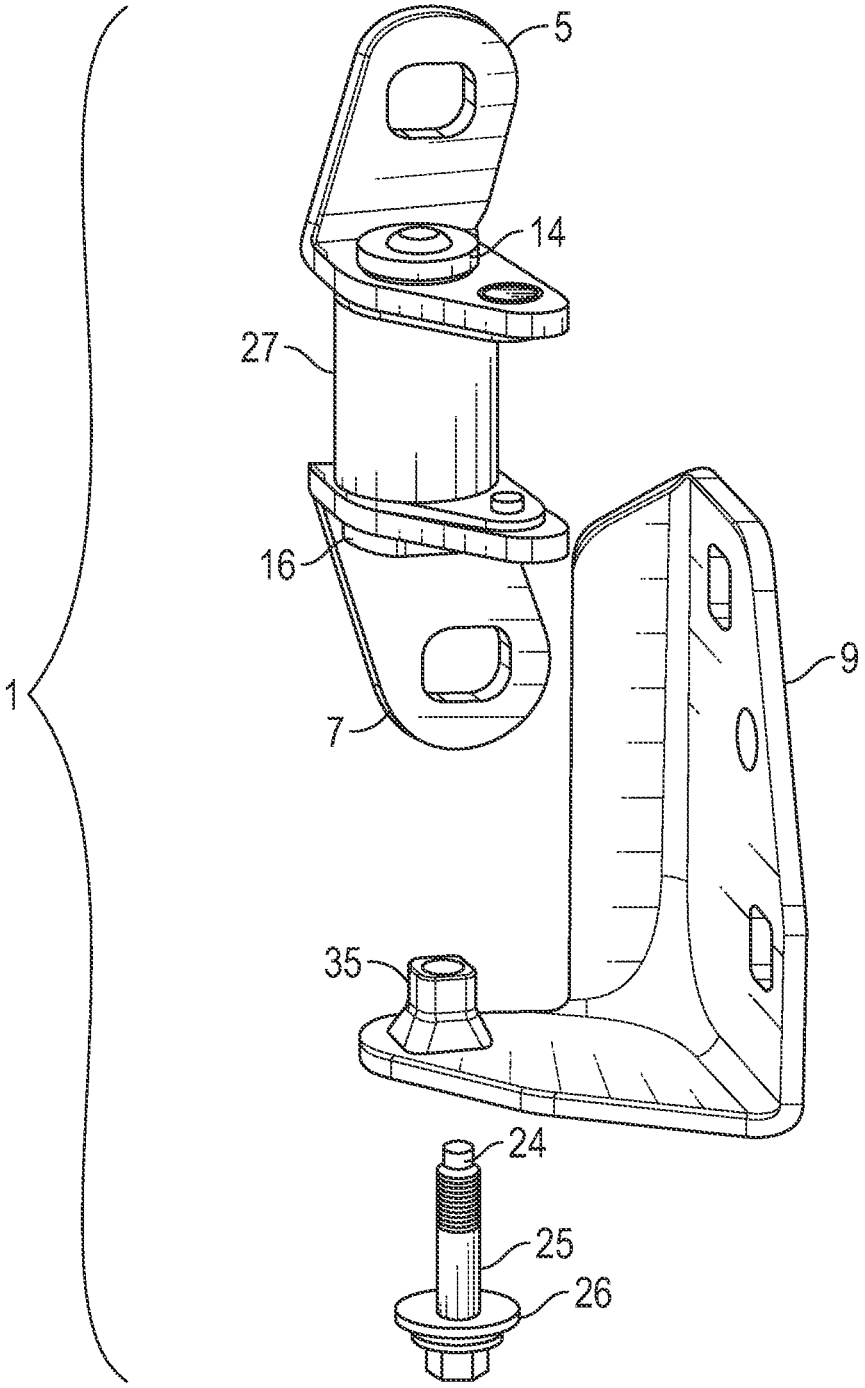
FIG. 4 is an exploded perspective view of the lift-off hinge with integrated door check of the invention.

A threaded fastener 25, as illustrated in FIG. 4, is adapted to engage the interiorly threaded intermediate portion 23 of the detent shaft 11. The threaded fastener 25 is typically a bolt.

Figure 2:
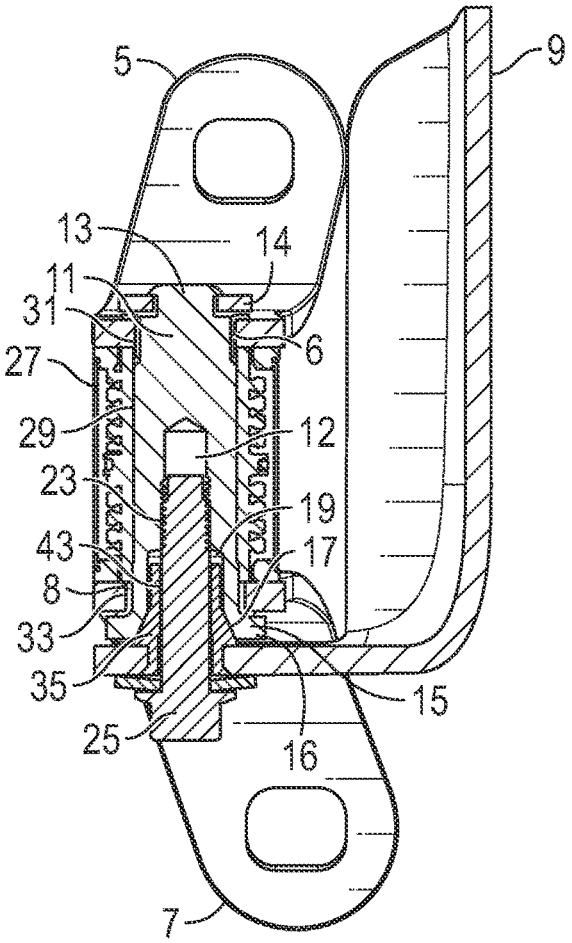
FIG. 2 is a cross-sectional elevation view of the lift-off hinge with integrated door check of the invention.
Figure 3:
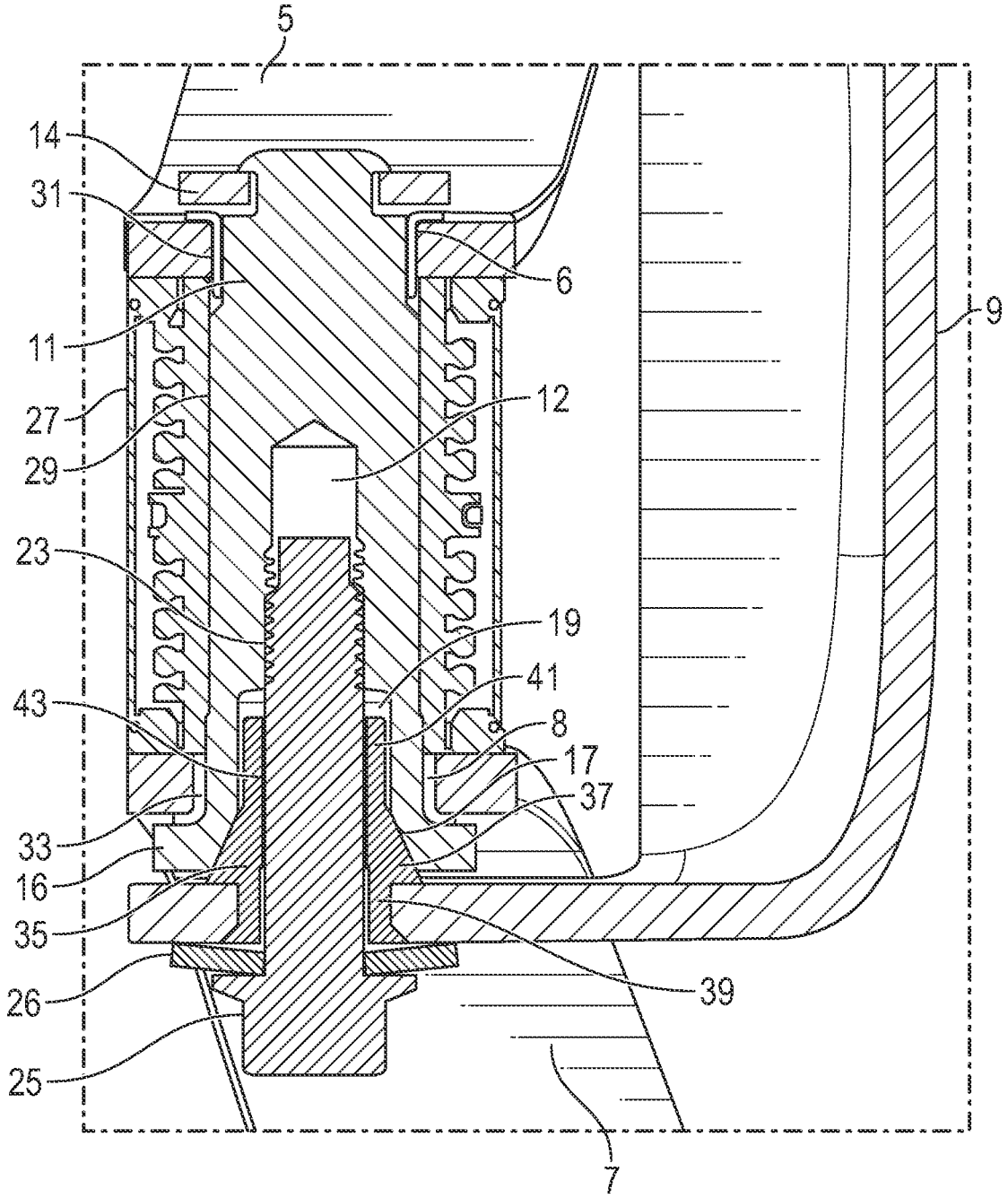
FIG. 3 is a cross-sectional elevation view of the lift-off hinge with integrated door check of the invention through plane "2" of FIG. 1.

The lift-off hinge 1 further comprises a cylindrical check mechanism 27 with an open central core 29. The cylindrical check mechanism 27 is illustrated, for example, in FIG. 3. The detent shaft 11 is adapted to rotate within the open central core 29 of the cylindrical check mechanism 27 by means of a first end bushing 31 and a second end bushing 33, as illustrated in FIGS. 2 and 3.

Figure 5:
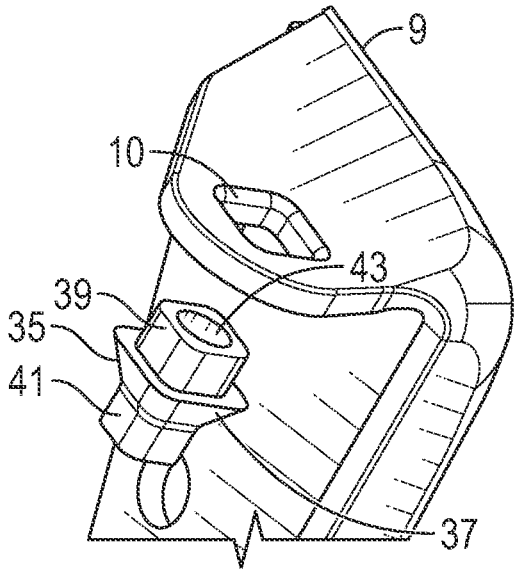
FIG. 5 is a perspective view of the guide pin and part of the body side hinge bracket of the invention prior to assembly to each other.
Figure 6:
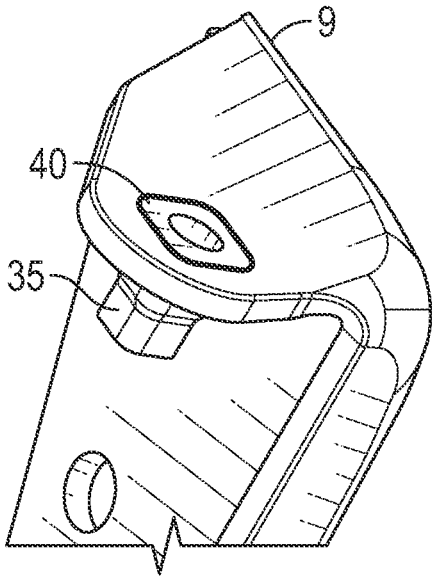
FIG. 6 is a perspective view of the guide pin and part of the body side hinge bracket of the invention following assembly to each other.
Figure 7:
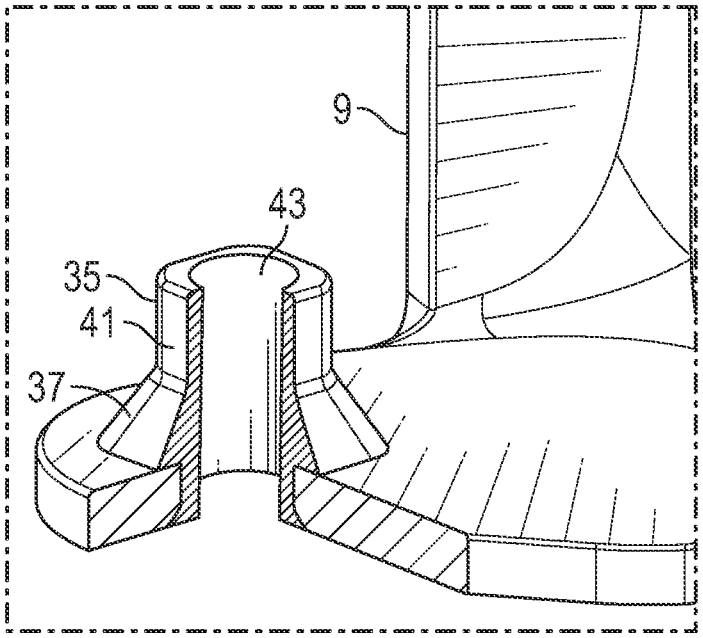
FIG. 7 is a perspective partially cut-away view of the guide pin and part of the body side hinge bracket of the invention following assembly to each other.

A guide pin 35 is an integral element of the lift-off hinge 1. The guide pin 35 comprises a central portion 37 preferably having a square base pyramidal shape, a polygonal first portion 39 which is preferably square shaped and may comprise a tenon, a polygonal second portion 41 which is also preferably square shaped, and a pin hollow core 43. FIGS. 5 to 7, for example, illustrate the guide pin 35.

The hinge is formed with a door side half and a body side half which are adapted to be removably attached to each other.

Figure 9:
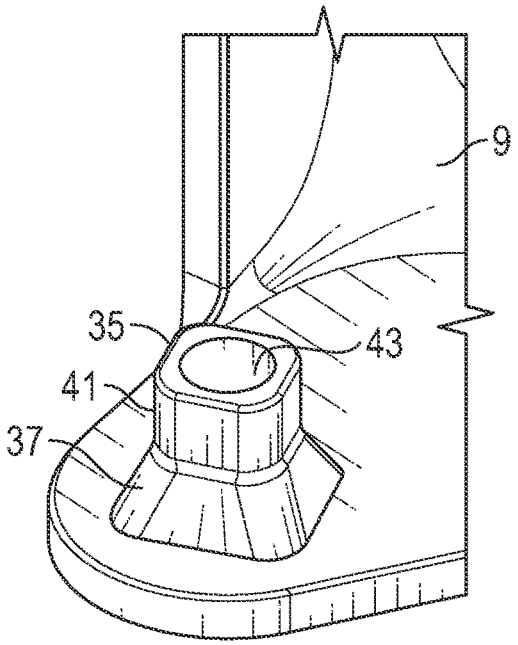
FIG. 9 is a perspective view of the guide pin and part of the body side hinge bracket of the invention following assembly to each other.
Figure 10:
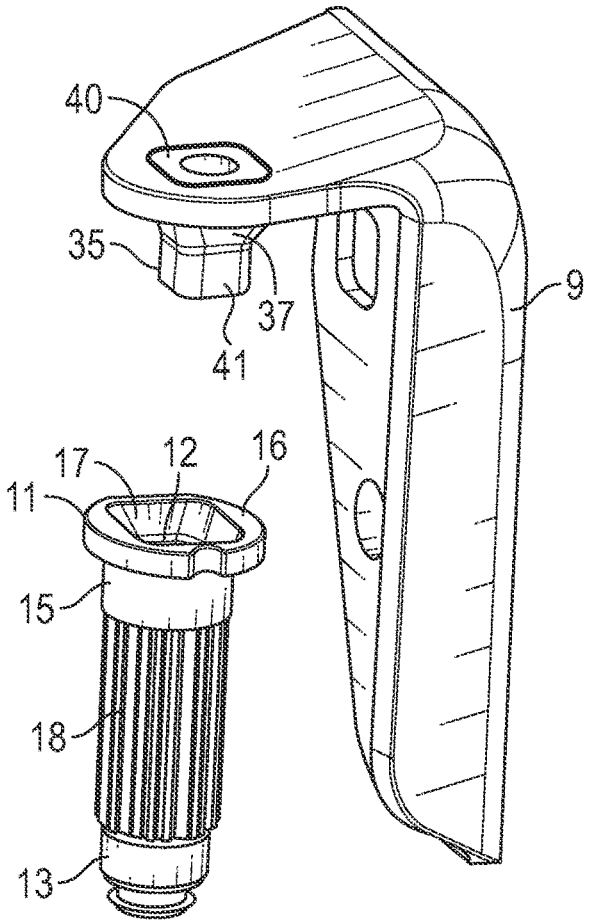
FIG. 10 is a perspective view of the isolated detent shaft and the assembled guide pin and body side hinge bracket prior to attachment of the detent shaft to the guide pin.
Figure 11:
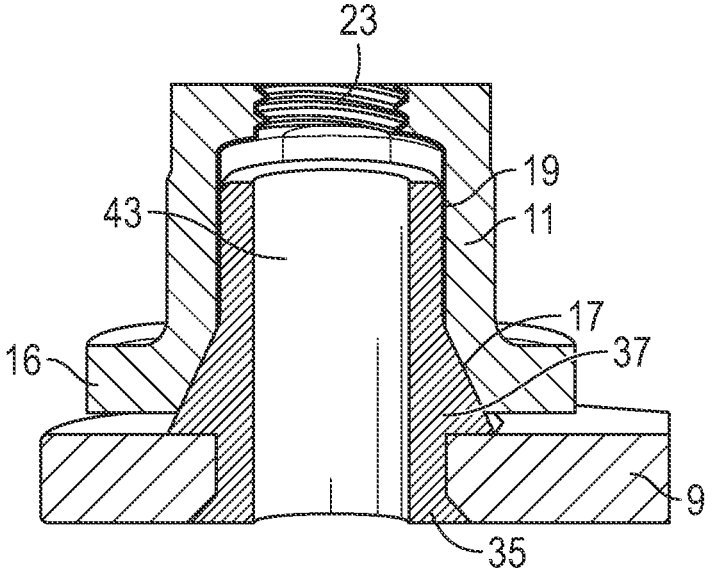
FIG. 11 is a cross-sectional elevation view of the assembled guide pin and body side hinge bracket with the detent shaft mounted thereto but not fastened.

Beginning with the body side half, FIG. 5 illustrates the polygonal first portion 39 of the guide pin 35 ready to be inserted into a correspondingly shaped opening or orifice 10 in the body side hinge bracket 9. To facilitate smooth engagement of the parts, the external corners of the polygonal first portion 39 of the guide pin 35 and the internal corners of the orifice 10 may be rounded. The guide pin 35 is inserted to its limit of travel when a surface of the square base pyramidal central portion 37 of the guide pin 35 abuts a facing surface of the body side hinge bracket 9. The four corners of the square base pyramidal central portion 37 provide multiple lines of contact for significant stability and strength on a solid base without deforming the body side hinge bracket 9. Following insertion, the guide pin 35 may be affixed to the body side hinge bracket 9 by swaging a protruding portion at the end of the polygonal first portion 39, or tenon. The swaged portion 40 of the tenon 39 is illustrated in FIGS. 6 and 10. Other methods of material upset, such as staking, or alternative methods such as welding, may also be employed to fix the guide pin 35 to the body side hinge bracket 9. FIGS. 7 and 9 illustrate the guide pin 35 fixed to the body side door bracket 9 from the opposite perspective of FIGS. 5 and 6. The partially cutaway view of FIG. 7 shows the pin hollow core 43 of the guide pin 35.

Turning to the door side half, as illustrated in FIGS. 2, 3 and 4, the cylindrical check mechanism 27 is constructed similarly to that described in U.S. Pat. No. 6,481,056. In the case of this invention, the cylindrical check mechanism 27 rests on the second door side hinge bracket 7 about a second orifice 8 in the second door side hinge bracket 7. The first end 13 of the detent shaft 11 is inserted through the second orifice 8 and the open central core 29 of the cylindrical check mechanism 27. The first door side hinge bracket 5 is then mounted over the first end 13 of the detent shaft 11 so that the first end 13 of the detent shaft 11 extends through the first orifice 6 in the first door side hinge bracket 5. A flange 16 at the second end 15 of the detent shaft 11 abuts the second door side hinge bracket 7 to limit further longitudinal movement of the detent shaft 11. A washer 14 is placed over the first end 13 of the detent shaft 11 and the first end 13 is then swaged over the washer to link the first door side hinge bracket 5 to the second door side hinge bracket 7. The cylindrical check mechanism 27 maintains the separation between the first and second door side hinge brackets 5, 7. Axial rotation of the detent shaft 11 within the first orifice 6 and second orifice 8 of the first door side hinge bracket 5 and the second door side hinge bracket 8 respectively is facilitated by first end bushing 31 and second end bushing 33.

The door side half may be affixed to the automotive door 3 prior to or following assembly of the door side half as described above. The first door side hinge bracket 5 and the second door side hinge bracket 7 are typically bolted to the door 3 using conventional means. These brackets 5 and 7 may also be attached to the door 3 by welding or other suitable bonding means.

Similarly, the body side half may be affixed to the automotive vehicle body prior to or following assembly of the body side half as described above. The body side hinge bracket 9 is typically bolted to the body using conventional means. The body bracket 9 may also be attached to the body by welding or other suitable bonding means.

With the door side half and the body side half assembled and affixed to the door 3 and body respectively, the door side half may be removably attached to the body side half. The detent shaft 11 is adapted to engage the guide pin 35. Typically, the contact will take place at the central portion 37 of the guide pin 35 with a square base pyramidal shape, and the similarly shaped detent shaft feature 17 of the detent shaft 11 to create a form fit. Again, the square external corners or edges of the central portion 37 of the guide pin 35 and the internal corners of the detent shaft feature 17 may be rounded to facilitate sliding these parts into and out of engagement. Preferably, there is play between the non-contacting portions of the guide pin 35 and the shaft hollow core 12 of the detent shaft 11 so that precise registration is ensured at the contacting surfaces with no other surfaces competing for contact or interfering with such contact. The polygonal second portion 41 of the guide pin 11 acts as a guide feature and provides temporary retention of the first section 19 of the shaft hollow core 12 of the detent shaft 11 during hinge assembly.

As described above, the door 3 may then be lifted off the body. The corresponding shaping of the guide pin 35 and the detent shaft 11 where they contact ensures that the door 3 will be registered precisely as previously with the body no matter how many times the door 3 is removed and replaced. As described above, the right angle indexing of the pyramidal guide pin 35 requires the door to be rehung in the correct position since rotating the door in either direction by 90 degrees would limit access to the hinge excessively or risk damage to the door. Although a square pyramidal shape for the guide pin 35 is preferred, a trilobal or hexagonal shape would also work.

Figure 12:
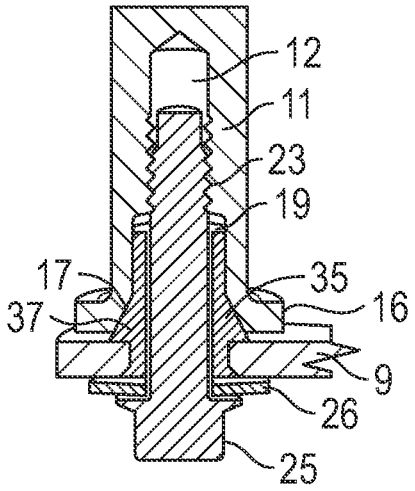
FIG. 12 is a cross-sectional elevation view of the assembled guide pin and body side hinge bracket with the detent shaft mounted thereto and fastened with the threaded fastener.

When the door 3 is ready to be rotationally and axially fixed to the body, the threaded fastener 25 is passed, typically, through a second washer 26, through the hollow core 43 of the guide pin 35 and into the interiorly threaded intermediate portion 23 of the detent shaft 11. Typically, the leading end 24 of the threaded fastener 25 is of lesser diameter than the interiorly threaded intermediate portion 23 of the detent shaft 11 so that the when the threaded fastener 25 is fully tightened into the interiorly threaded intermediate portion 23, its leading end 24 is not in contact with the detent shaft 11. Tightening the threaded fastener 25 forces the two pyramidal faces 37, 17 of the guide pin 35 and the detent shaft 11 respectively into firm engagement and restrains other degrees of freedom in order to generate a structural joint. The fastened joint is illustrated, for example, in FIGS. 2, 3 and 12.

To achieve the door checking functionality of the lift-off hinge, the detent shaft 11 is provided with grooves or splines 18 which engage with spring loaded rollers in the open central core 29 of the cylindrical check mechanism 27 as the detent shaft 11 rotates within the cylindrical check mechanism. Interaction of the splines 18 and the spring loaded rollers in the open central core 29 creates detent torque which permits the door 3 to be checked in a number of discrete positions as it is rotated open and closed. As noted above, this form of door check integrated with a hinge is described in U.S. Pat. No. 6,481,056.

Although the illustrated lift-off hinge is preferably used with a check mechanism, it could be used without a check mechanism to prevent rotation of a pin during fastener tightening. The polygonal shapes described above facilitate this function.

Figure 13:
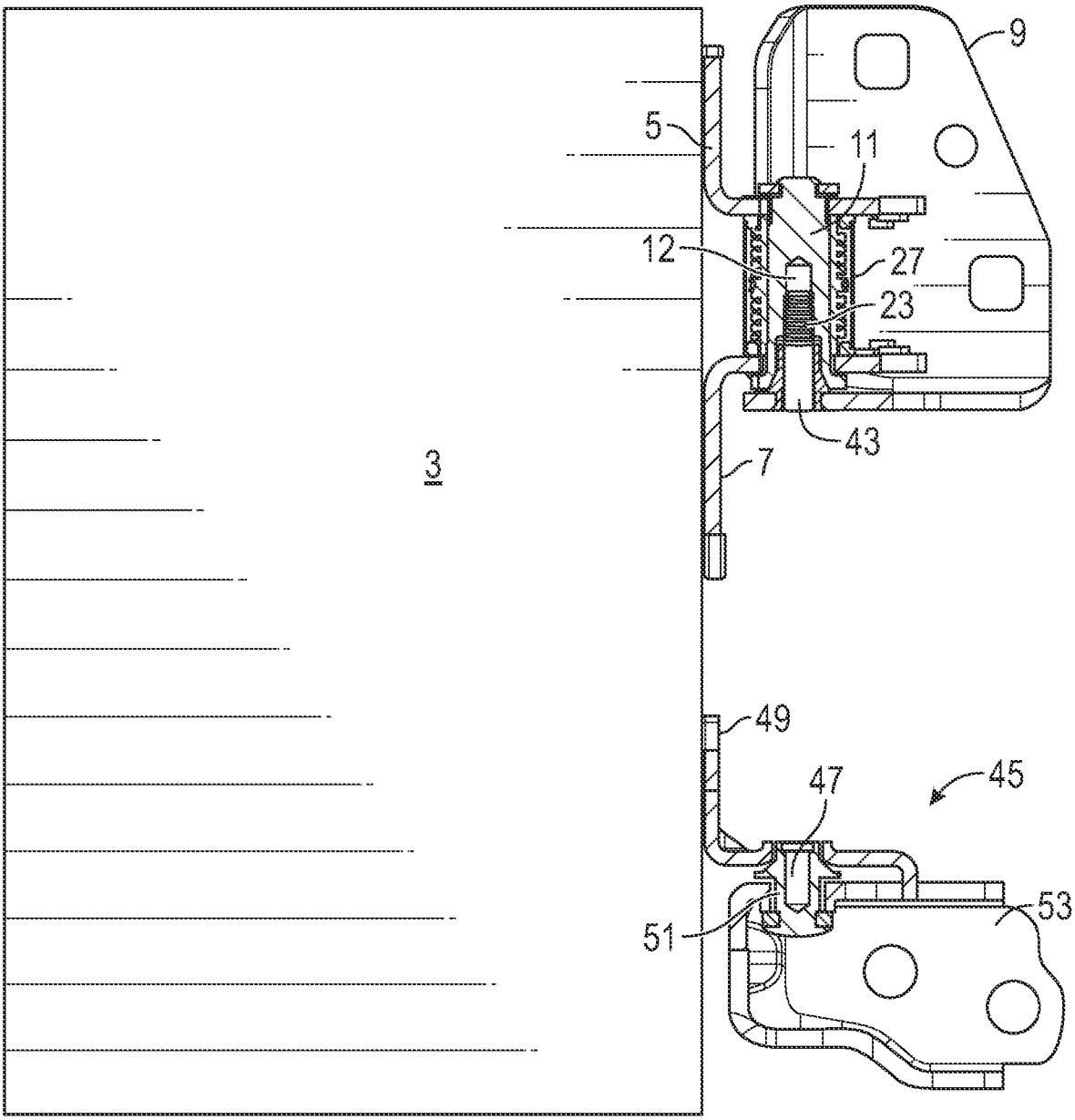
FIG. 13 is a cross-sectional elevation view of the assembled lift-off hinge with integrated door check fastened to a schematic vehicle door, along with a lower lift-off hinge fastened to the vehicle door.

As illustrated in FIG. 13, a second hinge joint 45, typically the lower of a pair of hinges for each door, may be simpler than the typically upper lift-off hinge with integrated door check 1. A lower guide pin 47 mounted in the lower door side hinge bracket 49 may simply be fitted through lower body bracket orifice 51 in the lower body side hinge bracket 53. When the threaded fastener 25 is tightened in the upper hinge 1, the lower guide pin 47 in the lower hinge joint 45 is also necessarily constrained from vertical movement. The lower door side hinge bracket 49 and the lower body side hinge bracket 53 may rotate in relation to each other along with the upper first and second door side hinge brackets 6, 8 in relation to the upper body side hinge bracket 1. Alternatively, the lower hinge joint 45 can be fastened using conventional means, if warranted.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

The invention claimed is:

1. An automotive lift-off hinge joint to rotationally connect an automotive door and body, comprising:

a first door side hinge bracket and a second door side hinge bracket;

a body side hinge bracket;

a detent shaft with a first end, a second end and a shaft hollow core provided with a shaped detent shaft feature and an interiorly threaded intermediate portion adapted to receive a removable threaded fastener;

a first end bushing and a second end bushing located respectively adjacent the first end and the second end of the detent shaft;

a cylindrical check mechanism with an open central core adapted to receive the first end and the intermediate portion of the detent shaft;

said first end bushing and second end bushing being located between the detent shaft and the first and second door side hinge brackets respectively;

the first end of the detent shaft being rotationally affixed to the first door side hinge bracket and the second end of the detent shaft being rotationally affixed to the second door side hinge bracket;

a guide pin with a square base pyramidal shape at a central portion, a polygonal first portion, a polygonal second portion and a pin hollow core adapted to receive the removable threaded fastener;

the first portion of the guide pin being non-rotationally affixed to the body side hinge bracket;

the shaped detent shaft feature non-rotationally engaging the correspondingly shaped central portion of the guide pin;

the second portion of the guide pin being received within a correspondingly shaped first section of the shaft hollow core without contact therebetween;

such that when the fastener is fully tightened, a door is rotationally connected to a body and when the fastener is removed, the door may be removed from the body.

2. The automotive lift-off hinge joint of claim 1, wherein the polygonal first portion and second portion of the guide pin are square shaped.

3. The automotive lift-off hinge joint of claim 1, wherein the guide pin is fixed to the body side hinge bracket by swaging or staking.

4. The automotive lift-off hinge joint of claim 1, wherein the guide pin is fixed to the body side hinge bracket by welding or bonding.

5. The automotive lift-off hinge joint of claim 1, wherein the detent shaft is grooved and interacts rotationally with spring-loaded rollers in the check mechanism to generate a detent torque at multiple, discrete positions.

6. The automotive lift-off hinge joint of claim 1, wherein the first portion of the guide pin constitutes a tenon which is inserted into a correspondingly shaped opening in the body side hinge bracket and swaged to join the guide pin to the body side hinge bracket.

7. The automotive lift-off hinge joint of claim 1, wherein the corners of the polygonal first portion and second portion, and the square shaped central portion of the guide pin are rounded to facilitate smooth registration with the corresponding portions of the detent shaft and body side bracket with which they respectively mate.

* * * * *